US011234499B2

(12) United States Patent
Koganei et al.

(10) Patent No.: US 11,234,499 B2
(45) Date of Patent: Feb. 1, 2022

(54) GEMSTONE

(71) Applicant: GEM S.T.S. CO., LTD., Tokyo (JP)

(72) Inventors: Hiroyuki Koganei, Kanagawa (JP); Shu Shiraishi, Tokyo (JP); Tsubasa Koganei, Kanagawa (JP)

(73) Assignee: GEM S.T.S. Co., Ltd., Tokyo (JP)

( * ) Notice: Subject to any disclaimer, the term of this patent is extended or adjusted under 35 U.S.C. 154(b) by 0 days.

(21) Appl. No.: 16/337,303

(22) PCT Filed: Sep. 29, 2016

(86) PCT No.: PCT/JP2016/078909
§ 371 (c)(1),
(2) Date: Mar. 27, 2019

(87) PCT Pub. No.: WO2018/061157
PCT Pub. Date: Apr. 5, 2018

(65) Prior Publication Data

US 2019/0223565 A1 Jul. 25, 2019

(51) Int. Cl.
*A44C 17/00* (2006.01)

(52) U.S. Cl.
CPC ..... *A44C 17/001* (2013.01); *A44C 17/00* (2013.01)

(58) Field of Classification Search
CPC ..... A44C 17/00; A44C 17/001
USPC ..... D11/89, 90
See application file for complete search history.

(56) References Cited

U.S. PATENT DOCUMENTS

D462,030 S * 8/2002 Rydlewicz ..... D11/90
6,604,382 B2 * 8/2003 Shuto ..... A44C 17/001 63/32
D510,887 S * 10/2005 Namdar ..... D11/90
D524,186 S * 7/2006 Sato ..... D11/90
D529,836 S * 10/2006 Sanghvi ..... D11/90
7,225,641 B2 * 6/2007 Kawabuchi ..... A44C 17/001 63/32

(Continued)

FOREIGN PATENT DOCUMENTS

EP 2 179 672 4/2010
EP 2179672 A1 * 4/2010 ..... A44C 17/001

(Continued)

OTHER PUBLICATIONS

Office Action issued in corresponding Indian Patent Application No. 201917016299, dated Apr. 29, 2021, 6 pages.

*Primary Examiner* — Emily M Morgan
(74) *Attorney, Agent, or Firm* — Hamre, Schumann, Mueller & Larson, P.C.

(57) ABSTRACT

Provided is a gemstone treated with a cut expressing a reflected image pattern not recognized before, wherein the gemstone includes the crown 100 having the table 110 and plural bezel facets 130, and the pavilion 200 having the culet 210 and plural main facets 220; the girdle 300 is formed between the crown 100 and the pavilion 200; a direction of a horizontal component of an inclination direction of the bezel facet 130 from the table 110 to the girdle 300 is set to be different from a direction of a horizontal component of an inclination direction of the main facet 220 from the culet 210 to the girdle 300; and inclination angles of the bezel facet 130 and the main facet 220 are set so that a light that enters the table 110 is reflected by two of the main facets 220 and emitted from the bezel facet 130.

6 Claims, 14 Drawing Sheets

(56) References Cited

U.S. PATENT DOCUMENTS

| | | | | | |
|---|---|---|---|---|---|
| D567,136 | S | * | 4/2008 | Sinclaire | D11/90 |
| D578,033 | S | * | 10/2008 | Shah | D11/90 |
| D698,277 | S | * | 1/2014 | Shimansky | D11/90 |
| D710,242 | S | * | 8/2014 | Itzchaki | D11/90 |
| D711,280 | S | * | 8/2014 | Tannenbaum | D11/90 |
| D718,179 | S | * | 11/2014 | Tannenbaum | D11/90 |
| D726,065 | S | * | 4/2015 | Berdan | D11/90 |
| D738,254 | S | * | 9/2015 | Hakimian | D11/90 |
| D743,296 | S | * | 11/2015 | Mehta | D11/90 |
| D778,201 | S | * | 2/2017 | Asscher | D11/90 |
| D785,495 | S | * | 5/2017 | Bhansali | D11/90 |
| D792,270 | S | * | 7/2017 | Higano | D11/90 |
| D814,339 | S | * | 4/2018 | Dholakiya | D11/90 |
| D831,529 | S | * | 10/2018 | Patel | D11/90 |
| D839,771 | S | * | 2/2019 | Rydlewicz | D11/90 |
| D839,778 | S | * | 2/2019 | Rydlewicz | D11/90 |
| D877,645 | S | * | 3/2020 | Mehta | D11/90 |
| D883,847 | S | * | 5/2020 | Bonke | D11/90 |
| D883,849 | S | * | 5/2020 | Koyama | D11/90 |
| D896,687 | S | * | 9/2020 | Parikh | D11/90 |
| D899,295 | S | * | 10/2020 | Loinger | D11/90 |
| 2002/0043078 | A1 | | 4/2002 | Kawabuchi et al. | |
| 2003/0192346 | A1 | * | 10/2003 | Samuels | A44C 17/001 63/32 |
| 2005/0011226 | A1 | * | 1/2005 | So | A44C 17/001 63/32 |
| 2009/0056374 | A1 | | 3/2009 | Abate | |
| 2011/0265514 | A1 | | 11/2011 | Fakier | |
| 2017/0202319 | A1 | | 7/2017 | Koganei et al. | |

FOREIGN PATENT DOCUMENTS

| | | | | | |
|---|---|---|---|---|---|
| EP | 2 383 126 | | | 11/2011 | |
| EP | 3315043 | A1 | * | 5/2018 | A44C 17/001 |
| GB | 1 352 933 | | | 5/1974 | |
| JP | 6-174648 | | | 6/1994 | |
| JP | 11-276219 | | | 10/1999 | |
| JP | 2000005993 | A | * | 1/2000 | A44C 17/001 |
| JP | 3643541 | | | 2/2005 | |
| JP | 2006-218163 | | | 8/2006 | |
| JP | 2010-201043 | | | 9/2010 | |
| JP | 5443022 | | | 3/2014 | |
| JP | 5788562 | | | 8/2015 | |
| WO | 2005/006909 | | | 1/2005 | |
| WO | 2006/085645 | | | 8/2006 | |
| WO | WO-2018015966 | A1 | * | 1/2018 | A44C 17/001 |

* cited by examiner

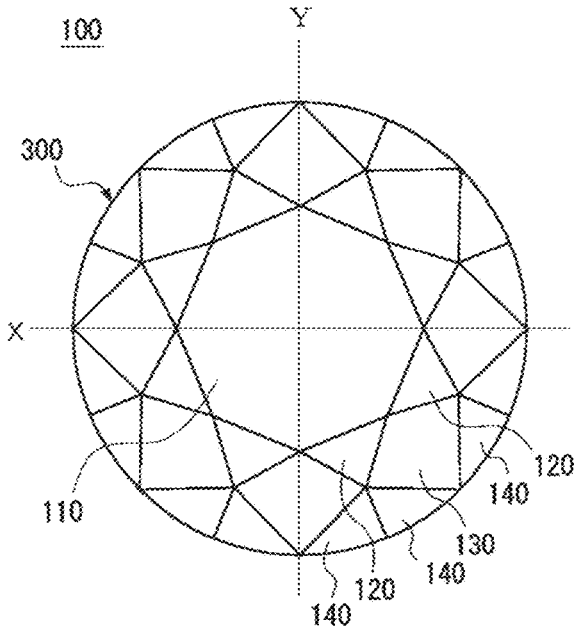
Fig. 1A - Prior Art
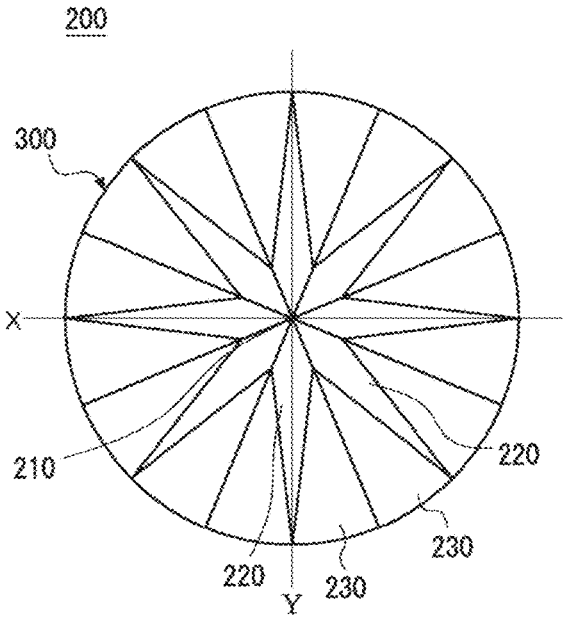
Fig. 1B- Prior Art
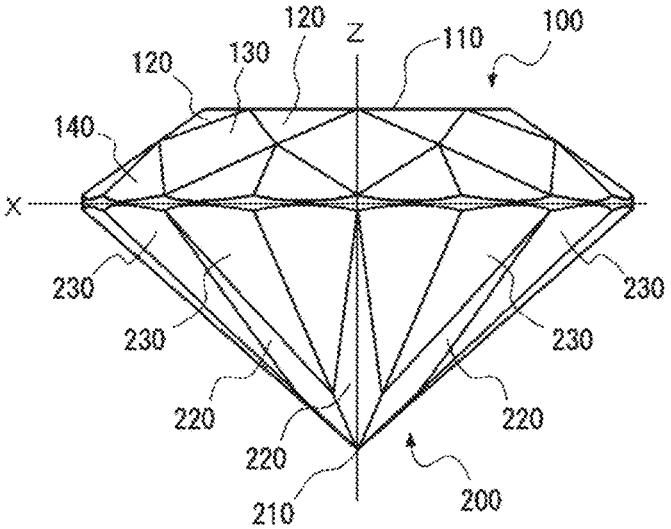
Fig. 1C - Prior Art FIG. 2A - Prior Art
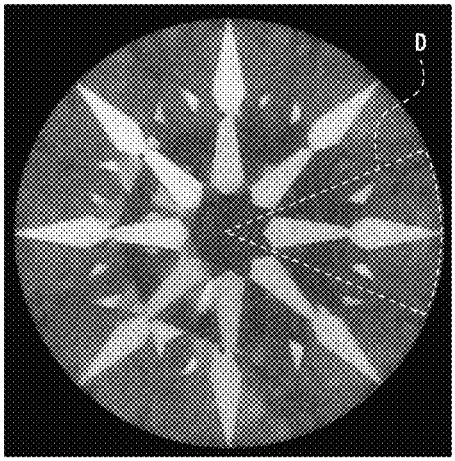
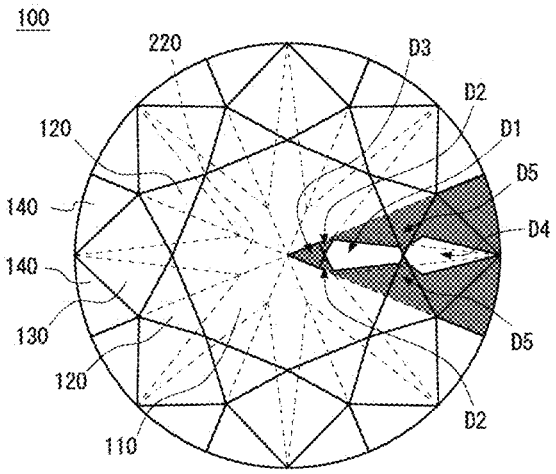
Fig. 2B - Prior Art

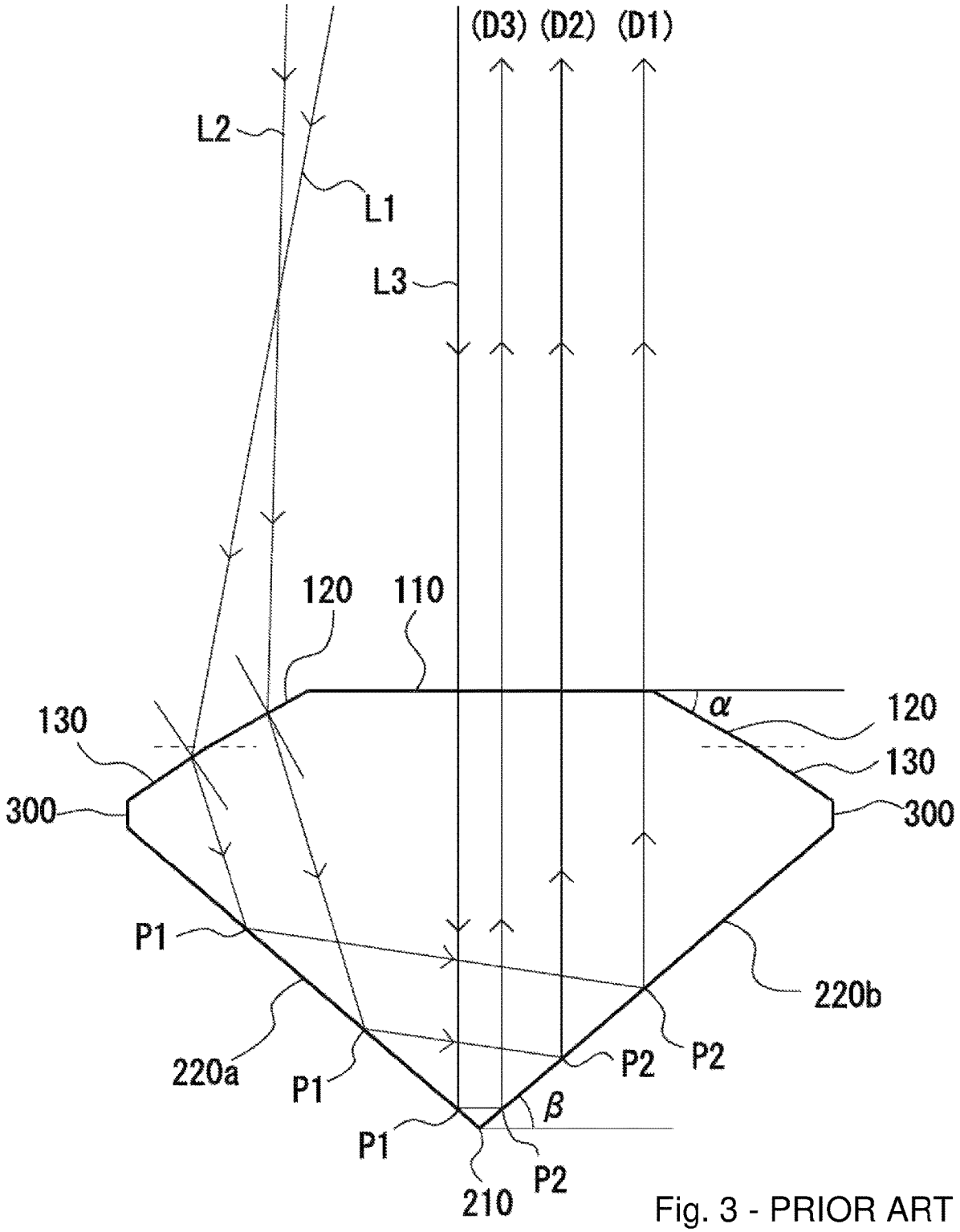
Fig. 3 - PRIOR ART

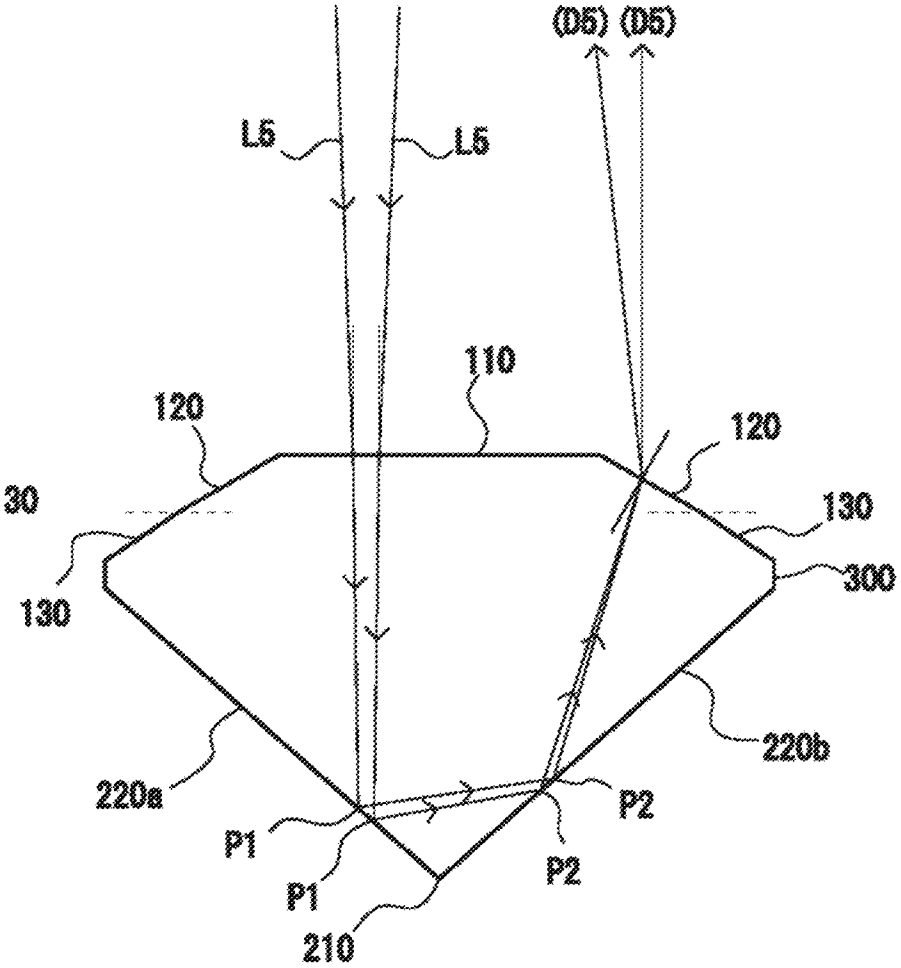
Fig. 4B - Prior Art
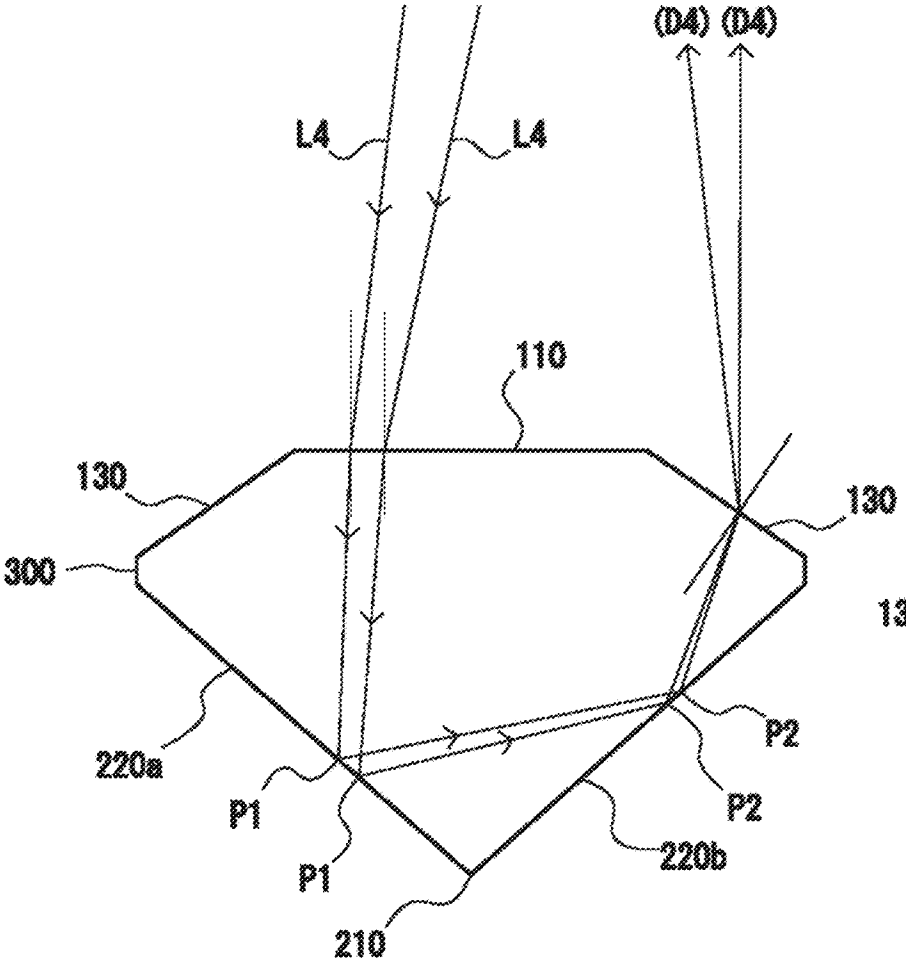
FIG. 4A - Prior Art

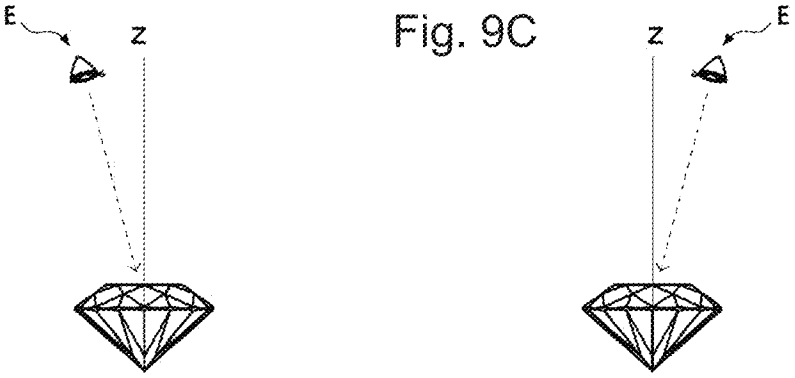
FIG. 9A
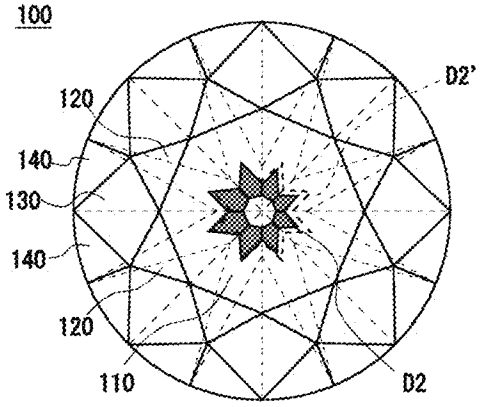
Fig. 9B
Fig. 9C
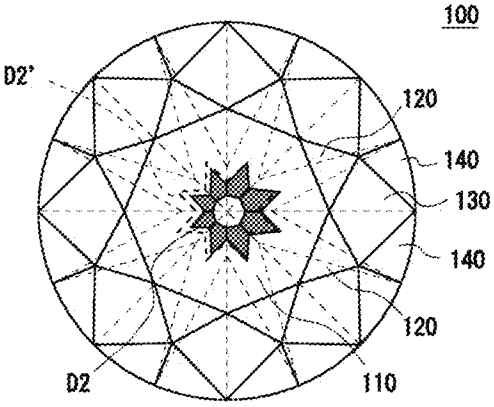
Fig. 9D

GEMSTONE

TECHNICAL FIELD

The present invention relates to a gemstone having a cut that can express a reflected image pattern not having been recognized before.

BACKGROUND ART

In the past, a round brilliant cut has been widely known as the cut to maximize a beautiful shine of a gemstone. Especially in a diamond, which is the material having a very high refractive index, when it is treated with the round brilliant cut, almost all of the lights entering the diamond from outside can be reflected internally. Accordingly, it is considered that this can maximize the beautiful shine inherent to the diamond, such as brilliance (white internal reflected light), fire (colored reflected lights such as red and blue), and sparkle (reflected light from surface).

FIGS. 1A-1C illustrate the gemstone treated with a conventional round brilliant cut, wherein FIG. 1A illustrates a top view, FIG. 1B illustrates a bottom view, and FIG. 1C illustrates a side view, of the gemstone respectively. The gemstone treated with this cut includes the crown 100 provided with the table 110 (upper plane), the pavilion 200 provided with the culet 210, and the girdle 300 that is cut to a round (circular) shape between the crown 100 and the pavilion 200.

In general, the culet refers to a small cut surface that is made to avoid a defect in the peak part of the pavilion. In the description including this specification and the claims, the one not having the small cut surface thereby having a sharp pavilion peak part (sharp culet) as illustrated in FIG. 1C is also considered to be included in the culet.

Among the diamonds treated with the conventional round brilliant cut, it has been known that those having an especially superior cut symmetry exhibit an eight arrow-shaped reflected image pattern as illustrated in FIGS. 2A-2B when it is observed from above the diamond (from the side of the crown 100 in FIG. 1A). This reflected image pattern can be visually recognized; but this can be confirmed more clearly by using "gemstone scope" described in Patent Document 1, Patent Document 2, and so forth. The beautiful arrow-shaped having a high symmetry can be visually recognized only in the gemstone having an especially superior cut symmetry. Accordingly, that the beautiful arrow-shaped having a high symmetry can be visually recognized is widely used as the method to demonstrate that this gemstone is of high quality.

On the other hand, the reflected image pattern such as an aforementioned symmetric arrow-shaped is also gaining an attention as a new added value in the gemstone design. The inventor of the present application proposed, in Patent Document 3 filed in the past, various cuts of the gemstone with which the reflected image patterns different from the arrow-shaped can be observed by devising the shape, the disposition, and the like of the main facets formed in the pavilion while cutting with a superior symmetry.

CITATION LIST

Patent Document

Patent Document 1: Japanese Patent Laid-Open Publication No. 1994-174648

Patent Document 2: Japanese Patent Laid-Open Publication No. 2010-201043

Patent Document 3: Japanese Patent No. 5788562

SUMMARY OF THE INVENTION

Problems to be Solved by the Invention

The present invention has an object to provide a gemstone treated with a cut with which a reflected image pattern not having been realized before can be expressed.

The inventors of the present application carried out an extensive investigation about a further added value of the gemstone design; and as a result, they found a cut with which the position of the reflected image pattern appears to swing depending on an observation angle of the observer. In conventional cuts of the gemstone, a dynamic reflected image pattern such as swinging depending on an observation angle of the observer has not been recognized Therefore, the cut with which swing of the reflected image pattern can be readily recognized with a visual observation has not been proposed.

The present invention has an object to provide a gemstone treated with a cut with which the reflected image pattern appears to swing depending on the observation angle.

Means for Solving the Problem

In order to solve the problem mentioned above, the gemstone according to the present invention comprises a crown having a table and a plurality of bezel facets and a pavilion having a culet and a plurality of main facets; a girdle is formed between the crown and the pavilion; a direction of a horizontal component of an inclination direction of the bezel facet from the table to the girdle is set to be different from a direction of a horizontal component of an inclination direction of the main facet from the culet to the girdle; and inclination angles of the bezel facet and the main facet are set so that a light that enters the table is reflected by two of the main facets and emitted from the bezel facet.

As described above, when the direction of the horizontal component of the inclination direction of the bezel facet is set to be different from the direction of the horizontal component of the inclination direction of the main facet, and the light that enters the table is emitted from the bezel facet, the reflected image pattern not having been recognized before can be expressed under the bezel facet.

A preferable embodiment of the present invention is characterized by that the bezel facet is divided into two or more and has two or more facets having different inclination directions.

By dividing the bezel facet as described above, a design of the reflected image pattern that is projected under the bezel facet can be changed.

In addition, the gemstone of the present invention is characterized by that the gemstone comprises a crown having a table and a plurality of star facets and a pavilion having a culet and a plurality of main facets; a girdle is formed between the crown and the pavilion;

the gemstone has two or more opposite pairs that the star facet and the main facet are disposed in a position opposite to each other in an axis line direction of an axis line that goes through a central part of the table and the culet;

each of the opposite pair is disposed in a line symmetry position with the axis line as a symmetry axis; and inclination angles of the star facet and the main facet are set so that a light that enters the star facet is reflected by two of the main facets and emitted from the table.

As described above, when the gemstone has two or more opposite pairs that the star facet and the main facet are disposed in a position opposite to each other in an axis line direction, and the opposite pair is disposed in a line symmetry position to each other with the axis line as a symmetry axis, the reflected image pattern that swings depending on the observation angle can be projected under the table.

A preferable embodiment of the present invention is characterized by that six or more of the star facets are disposed around the table, and six of the main facets are disposed around the culet, and six of the opposite pairs are formed.

As described above, when six of the opposite pairs are formed, a hexagram pattern that widely swings under the table as well as a hexagram pattern that slightly swings (or does not swing) under the bezel facet can be projected respectively.

A preferable embodiment of the present invention is characterized by that four or more of the star facets are disposed around the table, and four of the main facets are disposed around the culet, and four of the opposite pairs are formed.

As described above, when four of the opposite pairs are formed, a crisscross pattern that widely swings under the table as well as a crisscross pattern that slightly swings (or does not swing) under the bezel facet can be projected respectively.

Advantageous Effects of Invention

The present invention has an object to provide a gemstone treated with a cut with which a reflected image pattern not having been realized before can be expressed. In addition, the present invention can provide a gemstone treated with a cut with which the reflected image pattern observed appears to swing depending on an observation angle.

BRIEF DESCRIPTION OF THE DRAWINGS

FIGS. 1A-1C are an outer appearance of the gemstone treated with a conventional round brilliant cut.

FIGS. 2A-2B are views illustrating a reflected image pattern observed in the gemstone of FIGS. 1A-1C.

FIG. 3 is a view illustrating a light path of the light emitted from the table in the gemstone of FIG. 1.

FIGS. 4A-4B are views illustrating light paths of the lights emitted from the star facet and the bezel facet in the gemstone of FIGS. 1A-1C.

FIGS. 9A-9D are views illustrating an aspect how the reflected light image swings in the gemstone according to the first embodiment of the present invention.

DESCRIPTION OF THE EMBODIMENTS

Figure 5A:
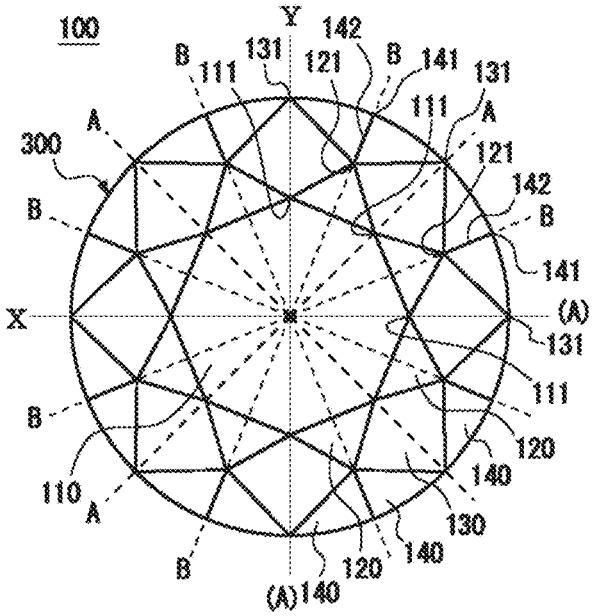
FIGS. 5A-5C are views illustrating an outer appearance of the gemstone according to the first embodiment of the present invention.

Hereinafter, the first to the third preferable embodiments of the present invention illustrated in the drawings will be explained in detail with reference to FIG. 1 to FIG. 14. The technical scope of the present invention is not limited to the embodiments illustrated in the accompanying drawings; and it can be changed appropriately within the scope described in the claims.

In order to understand the present invention, it is recognized that to understand the expression principle of the reflected image pattern in the conventional round brilliant cut is useful. Therefore, first, the expression principle of the reflected image pattern in the conventional round brilliant cut will be explained, and then, the expression principle of the reflected image pattern in the cut of the present invention will be explained.

<Conventional Round Brilliant Cut>

FIGS. 1A-1C illustrate a shape of the conventional round brilliant cut. This conventional round brilliant cut includes the crown 100 having the table 110, the pavilion 200 having the culet 210, and the girdle 300 formed between the crown 100 and the pavilion 200. Here, FIG. 1A illustrates a top view (crown side), FIG. 1B illustrates a back view (pavilion side), and FIG. 1C illustrates a front view, respectively.

FIGS. 2A-2B illustrate the reflected image pattern expressed in the crown side of the conventional round brilliant cut. FIG. 2A is a picture of the reflected image pattern observed by using a gemstone scope. FIG. 2B is a schematic view reflecting the cut of the crown side (solid lines) and the pavilion side (dotted lines). The reflected light images D1 to D5 in FIG. 2B correspond to the area of the reflected light image D in FIG. 2A.

The expression principle of the reflected light images D1 to D5 is explained in detail in Patent Document 3. In short, basically, they are projected by the principle described as follows. First, a light enters from the facet in the side of the crown 100 of the diamond. The light that enters the facet is influenced by the inclination of the facet and the inherent refractive index of the diamond; therefore the light is reflected successively at the first refection point P1 on the main facet 220*a* and at the second reflection point P2 on the main facet 220*b*; and then, it is emitted from inside the facet of the crown 100 side to outside the diamond. As a result, the reflected light images D1 to D5 as illustrated in FIGS. 2A-2B are projected in the side of the crown 100.

FIG. 3 depicts the light paths L1 to L3 with which the reflected light images D1 to D3 are projected. FIG. 4A depicts the light paths L4 with which the reflected light image D4 is projected; and FIG. 4B depicts the light paths L5 with which the reflected light image D5 is projected.

<Cut of the Gemstone According to the First Embodiment of the Present Invention>

Figure 5B:
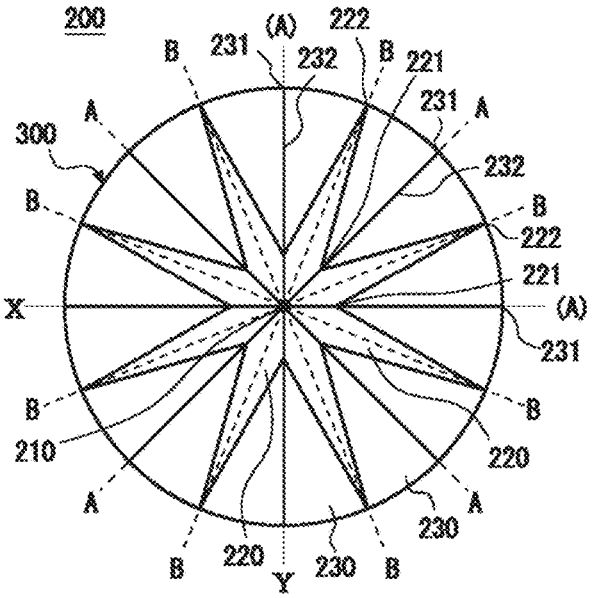
Figure 5C:
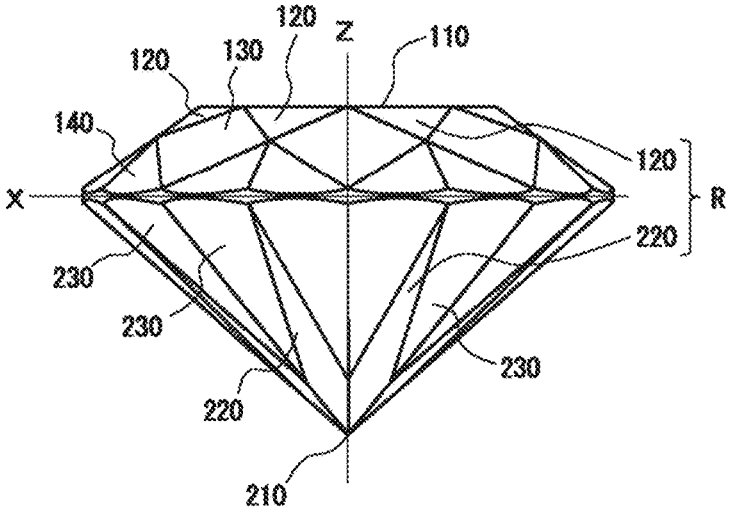

FIGS. 5A-5C illustrate the cut of the gemstone according to the first embodiment of the present invention. The gemstone according to the first embodiment has the shape that the pavilion 200 of the conventional round brilliant cut mentioned before is rotated around the Z-axis by 22.5°. Here, FIG. 5A illustrates a top view (crown 100 side), FIG. 5B illustrates a back view (pavilion 200 side), and FIG. 5C illustrates a front view, respectively.

In order to make the explanation easier, the axis line that goes through the central part of the table 110 and the culet 210 is set as the Z-axis. The X-axis that intersects perpendicularly with the Z-axis, and the Y-axis that intersects perpendicularly with the X-axis and the Z-axis are also set. Note that in the explanation hereinafter, the direction from the culet 210 to the table 110 along the Z direction is regarded as an upward direction, and reversely, the direction from the table 110 to the culet 210 is regarded as a downward direction, thereby defining the upward and downward directions. The direction along the XY plane is defined as a horizontal direction.

In FIG. 5A and FIG. 5B, the plane A that the ZX plane each is rotated around the Z-axis by 45° and the plane B that the plane A each is rotated around the Z-axis by 22.5° are depicted. In the explanation hereinafter, the direction extending from the axis line (Z-axis) to the girdle 300 along the plane A is defined as the A direction, and the direction extending along the plane B is defined as the B direction.

In FIG. 5A and FIG. 5B, the Z-axis is directed to the front and back directions of the paper, and in FIG. 5C, the Y-axis is directed to the front and back directions of the paper; and thus, they are not shown in the drawings. Here, the ZX plane and the ZY plane are regarded to be included in the plane A.

The gemstone according to this embodiment is provided with, similarly to the conventional round brilliant cut, the table 110 disposed in a central position of the crown 100, eight star facets 120 disposed so as to enclose the table 110, eight bezel facets 130 disposed so as to enclose the star facets 120, and sixteen upper girdle facets 140 disposed so as to enclose the bezel facet 130.

The table 110 is formed so as to be an octagonal shape having eight vertices 111. As can be seen in FIG. 5C, the table 110 is a plane that is parallel to the XY plane. As can be seen in FIG. 5A, the each vertex 111 is disposed on the plane A so as to form the table 110 with a regular octagonal shape having the central angle of 45°.

The star facet 120 is formed so as to be a trigonal shape formed by connecting two vertices 111, which are shared with the Table 110, and a vertex 121 disposed in the side closer to the girdle 300 than the vertices 111. The vertex 121 is disposed on the plane B and forms the star facet 120 that is an isosceles triangle in which an apex angle is an interior angle contacting with the vertex 121.

Here, the direction of the horizontal component (B direction) of the inclination direction of the star facet 120 from the table 110 to the girdle 300 is coincided with the direction of the horizontal component (B direction) of the inclination direction of the main facet 220 from the culet 210 to the girdle 300.

The bezel facet 130 is formed so as to be a rectangular shape formed by connecting one vertex 111, which is shared with the table 110, two vertices 121 and 121, which are shared with the adjacent star facets 120, and a vertex 131 disposed in the upper part of the girdle 300. The vertex 131 is disposed at the position where the girdle 300 and the plane A intersect to each other.

Here, the direction of the horizontal component (A direction) of the inclination direction of the bezel facet 130 from the table 110 to the girdle 300 is set to be different from the direction of the horizontal component (B direction) of the inclination direction of the main facet 220 from the culet 210 to the girdle 300.

The upper girdle facet 140 is formed so as to be a fan-shaped by connecting the vertex 121, which is shared with the star facet 120, the vertex 131, which is shared with the bezel facet 130, and a vertex 141 disposed in an intermediate position between the adjacent vertices 131 on the girdle 300. The vertex 141 is disposed at the position where the girdle 300 and the plane B intersect to each other. On the plane B, the ridge line 142 that connects between the vertex 121 and the vertex 141 is formed; and on both sides of the ridge line 142, the upper girdle facets 140 are formed with one for each side.

On the other hand, in the side of the pavilion 200, as shown in FIG. 5B, the culet 210 disposed in the central position of the pavilion 200, eight main facets 220 disposed radially around the culet 210, and sixteen lower girdle facets 230 disposed between the main facets 220 are placed.

The culet 210 may be either a sharp pavilion peak without a cut plane (sharp culet) as depicted in FIG. 5C or the one having a cut plane.

The main facet 220 is formed so as to be a rectangular shape formed by connecting the culet 210, two vertices 221 and 221, which are disposed in the adjacent planes A, and the vertex 222 disposed in the lower part of the girdle 300. The vertex 221 is formed in the position close to the culet 210 on the ridge line 232 formed along the plane A. The vertex 222 is disposed at the position where the girdle 300 and the plane B intersect to each other.

The lower girdle facet 230 is formed so as to be a fan-shaped by connecting the vertex 221, the vertex 222, both being shared with the main facet 220, and a vertex 231 disposed at the position where the girdle 300 and the plane B intersect to each other. The lower girdle facets 230 are formed on both sides of the ridge line 232 with one for each side.

The girdle 300 has a cylindrical surface in the outer circumference thereof and is disposed in parallel to the Z-axis, wherein the vertex 131 and the vertex 141 are disposed alternately in the upper part of the cylindrical surface; and the vertex 222 and the vertex 231 are disposed alternately in the lower part thereof.

In the cut of the gemstone according to the first embodiment, the vertex 121 that is the nearest to the girdle 300 among the vertices of the star facet 120 and the vertex 222 that is the nearest to the girdle 300 among the vertices of the main facet 220 are disposed on the same plane B. Therefore, the relative position of the main facet 220 to the star facet 120 is in the position opposite in the axis line direction of the axis line (Z-axis) going through the central part of the table 110 and the culet 210, as illustrated in FIG. 5C. In other words, the star facet 120 and the main facet 220 form the opposite pair R which is disposed in the position opposite with each other in the axis line direction, wherein eight opposite pairs thereof are disposed in an eight-fold symmetry around the axis line (Z-axis) as the center. Namely, the cut of the gemstone according to the present invention has two or more opposite pairs R that the star facet 120 and the main facet 220 are disposed in a position opposite to each other in the axis line direction of the axis line going through the central part of the table 110 and the culet 210, and each of the opposite pair R is disposed in a line symmetry position around the axis line as a symmetry axis.

Here, the inclination angle α (FIG. 3) of the star facet 120 and the inclination angle β (FIG. 3) of the main facet 220 of the gemstone according to the present invention is set so that a light that enters the star facet 120 is reflected by the two main facets 220*a* and 220*b* and emitted from the table 110.

Therefore, the inclination angle α of the star facet 120 to the table 110 is set to be in the range of 15.0 to 35.0°, and the inclination angle β of the main facet 220 to the table 110 is set preferably to be in the range of 37.0 to 43.0°.

When the inclination angle α of the star facet 120 is set in a lower limit side than 25.0°, which is the intermediate value of 15.0 to 35.0°, the inclination angle β of the main facet 220 is set preferably in a higher limit side than 40.0°, which is the intermediate value of 37.0 to 43.0°. On the contrary, when the inclination angle α of the star facet 120 is set in a higher limit side than the intermediate value (25.0°), the inclination angle β of the main facet 220 is set preferably in a lower limit side than the intermediate value (40.0°).

The inclination angle α of the star facet 120 to the table 110 is more favorably in the range of 21.0 to 26.0°, and the inclination angle β of the main facet 220 is more preferably in the range of 40.4 to 41.8°.

In addition, the inclination angle of the bezel facet 130 to the table 110 is set preferably in the range of 30.0 to 40.0°, and more preferably in the range of 31.0 to 36.0°.

Figure 6:
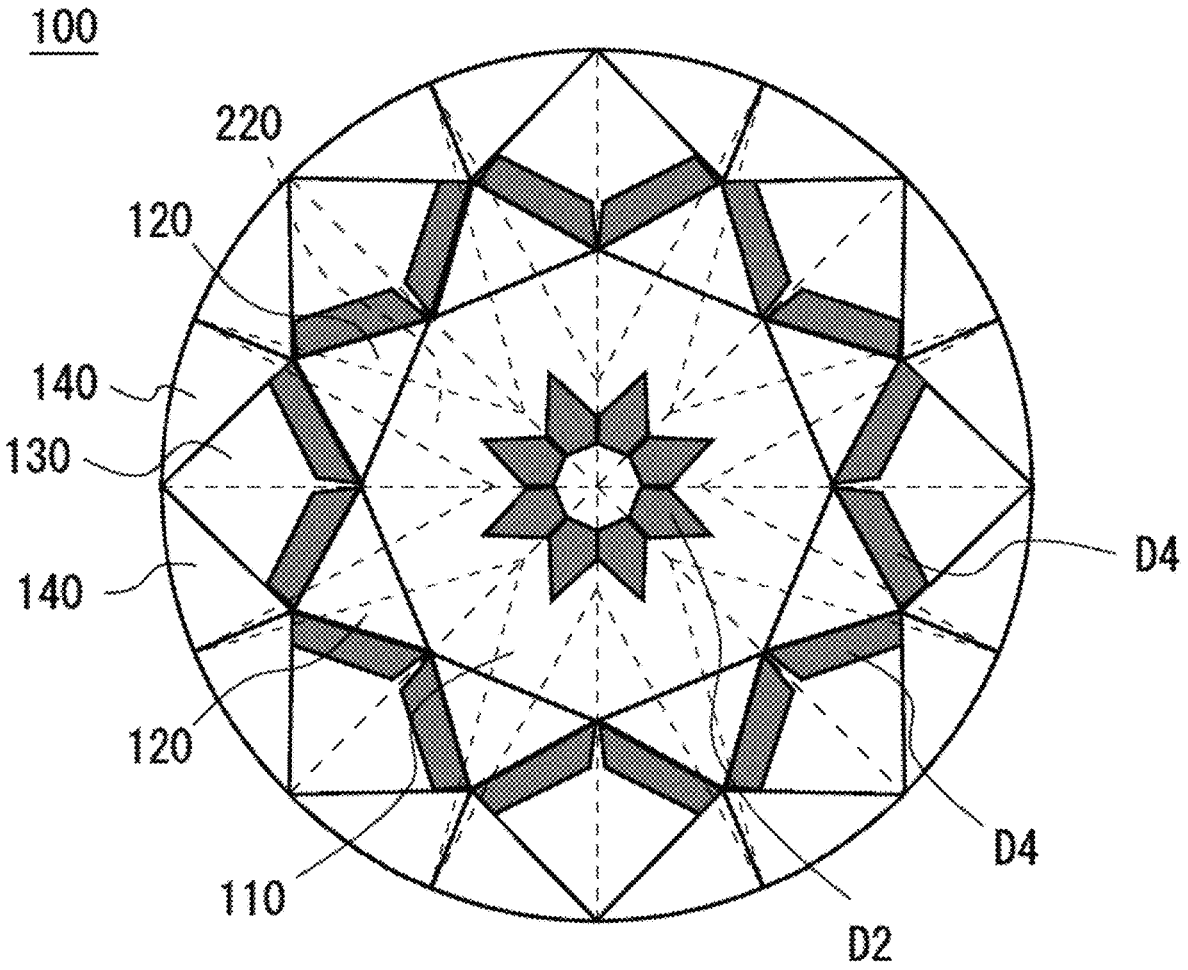
FIG. 6 is a view illustrating a reflected light image observed in the gemstone according to the first embodiment of the present invention.
Figure 7A:
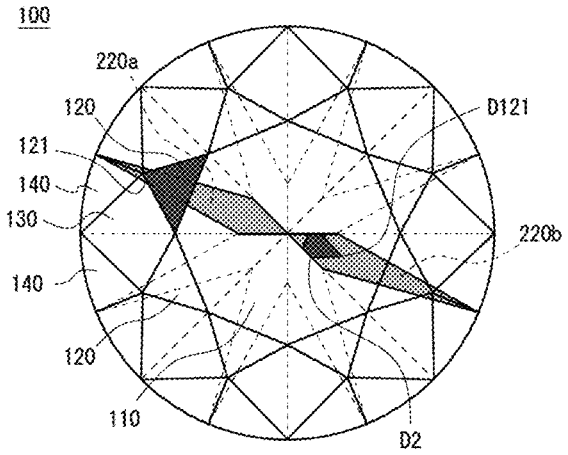
FIGS. 7A-7B are views illustrating an explanatory drawing of the light path of the reflected light image observed in the gemstone according to the first embodiment of the present invention.
Figure 7B:
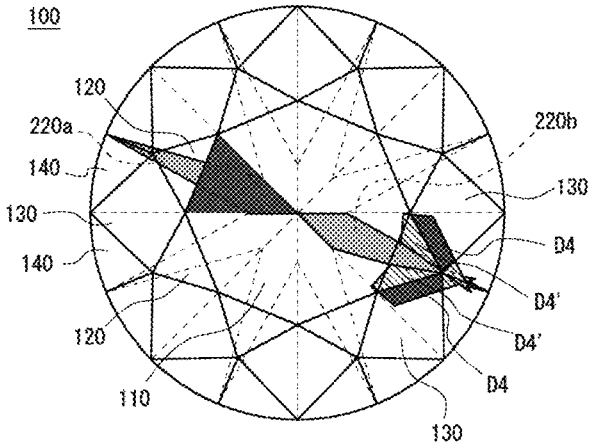

FIG. 6 illustrates the reflected light image D2 and the reflected light image D4 of the crown side of this embodiment observed by using the gemstone scope S. FIGS. 7A-7B are schematic drawings depicting how the reflected light image D2 and the reflected light image D4 are formed. FIG. 7A depicts the reflected image pattern that is formed by the light path L2 shown in FIG. 3. FIG. 7B depicts the reflected image pattern that is formed by the light path L4 shown in FIG. 4(*a*). In FIGS. 7A-7B, the facet through which the light passes and the reflected image pattern projected with a filled pattern, while the facet that reflects the light is projected with a half-tone dot meshing.

FIG. 7A illustrates how the reflected light image D2 is projected under the table 110 by the light that entered from the star facet 120 is reflected by the two main facets 220*a* and 220*b* along the light path L2. At the moment, the reflected light image D2 can be projected with a larger area as compared with the conventional round brilliant cut since the star facet 120 and the main facet 220 are disposed in the position opposite to each other in the axis line direction.

Especially, the vertex 121 of the star facet 120 that is the nearest vertex to the girdle 300 and the vertex 221 of the main facet 220 that is the nearest vertex to the girdle 300 are disposed on the same plane (on the plane B) formed along the axis line (Z-axis). As a result, the apex angle part (the part of the vertex 121) of the star facet 120 is projected at the outermost position D121 in the reflected light image D2.

FIG. 7B depicts how the reflected light image D4 is projected under the bezel facet 130 by the light that enters from the table 110 is reflected by the two main facets 220*a* and 220*b* along the light paths L4. At this time, the reflected light image D4' capable of being projected to the bezel facet 130 is projected with being rotated since the direction of the horizontal component of the inclination direction of the bezel facet 130 is different from the direction of the horizontal component of the inclination direction of the main facet 220 by 22.5°. Here, the shaded part of the reflected light image D4' is the area capable of being projected in the inclination direction and the inclination angle of the bezel facet 130, and this is not actually projected. Accordingly, the reflected light image D4 is projected so as to enclose the equal sides of the isosceles triangle of the star facet 120.

Note that, as depicted in FIGS. 2A-2B, the reflected light image D2 is projected darkly, while the reflected light image D4 is projected brightly. This is derived from the light areas α and β that are determined by the gemstone scope S. Hereinafter, this will be explained by using the drawing of the gemstone scope S.

Figure 8B:
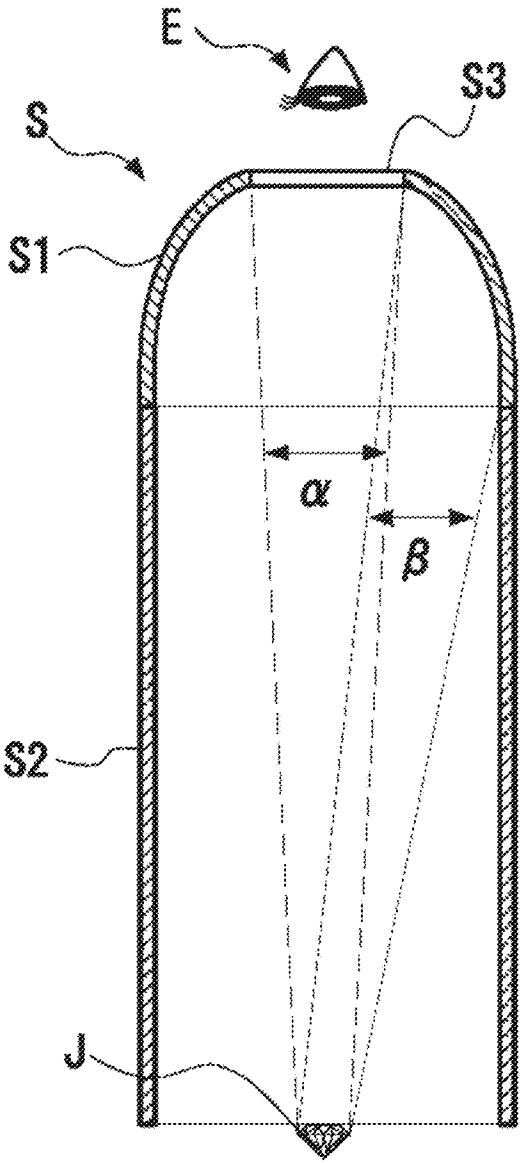
FIGS. 8A-8B are views illustrating a use state of the gemstone scope.
Figure 8A:
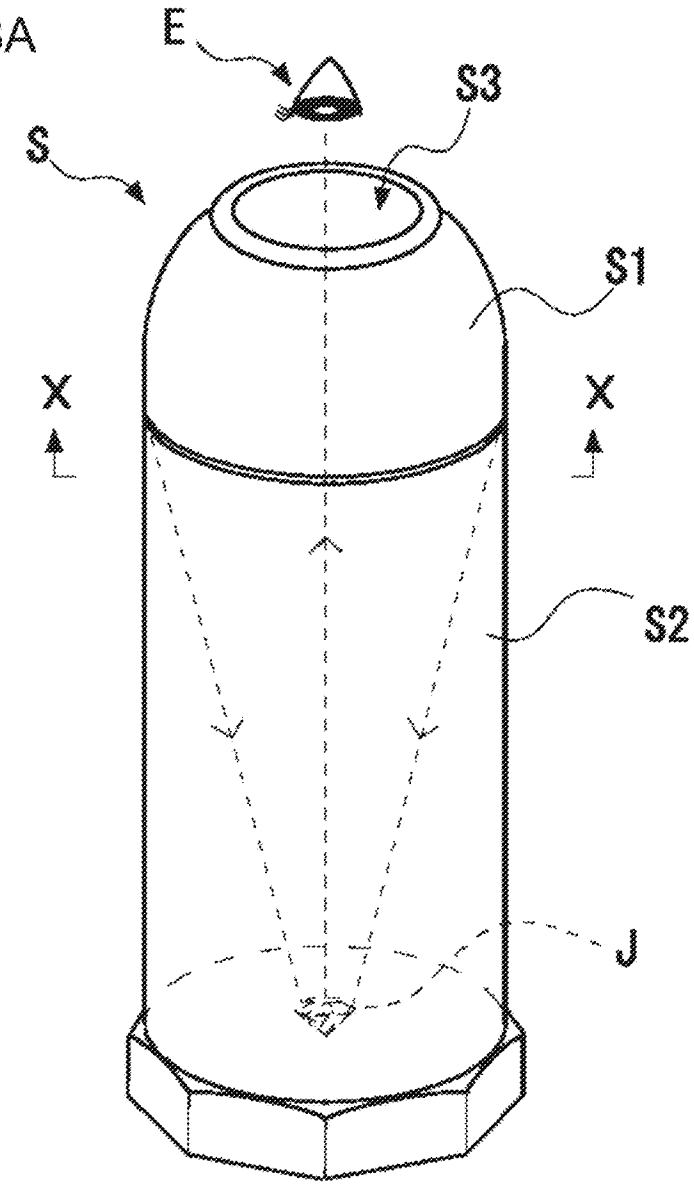

FIGS. 8A-8B are drawings that are depicting the gemstone scope S for observation of the reflected image pattern of the gemstone J. The gemstone scope S is provided with a light transmitting cylinder S1 having an inspection hole S3 formed and a light shielding cylinder S2 formed below the light transmitting cylinder S1. Though not shown by the drawing, the gemstone scope S having a magnifying lens installed in any of the light transmitting cylinder S1 and the light shielding cylinder S2 may be used.

By using the gemstone scope S having the aforementioned configuration as can be seen in FIG. 8A, a light only from one direction (namely, an upward direction of the gemstone J) in the disposed light transmitting cylinder S1 can be made to enter the gemstone J with shielding the light entering from a side direction of the gemstone J. Therefore, the reflected image pattern expressed by reflection of the light entered from one direction (upward direction) of the gemstone J can be observed from the inspection hole S3.

FIG. 8B is the cross section view of the X-X line of FIG. 8B to illustrate the light that enters the gemstone J in detail. The area cc shown in FIG. 8B is the region of the light that enters from the direction of the inspection hole S3 into the gemstone J; furthermore it is an observable region of the reflected image of the gemstone J from the inspection hole S3. At the time of observation of the gemstone J, the observer E covers the inspection hole S3 hence the light entering from the area cc is weak (dark). Therefore, the reflected image pattern projected by the light in the area cc is expressed as a dark portion.

On the other hand, the area β shows the region of the light that passes through the light transmitting cylinder S1 and enters the gemstone J. The light of the area β passes through the light transmitting cylinder S1 having a high light transmittance; thus, this light is stronger (brighter) than the light of the area α. Therefore, the reflected image pattern projected by the light of the area β is expressed as a bright portion and projected with the color of the light transmitting cylinder S1. Note that in FIG. 8B, only part of the area β is depicted for explanation; but practically an area having a ring-like shape so as to enclose the area α is formed.

Accordingly, the reflected light image D2 is projected darkly because it reflects the light of the area α, and the reflected light image D4 is projected brightly because it reflects the light of the area β.

Here, the reflected light images D3 and D5 are projected darkly because they reflect the light of the area α, and the reflected light image D1 is projected brightly because it reflects the light of the area β (see FIGS. 2A-2B).

FIGS. 9A-9D are drawings that are depicting how the reflected light image D2 projected under the table 110 swings in accordance with the observation angle when this angle is changed. FIG. 9A shows how the gemstone is observed from a certain diagonal direction; and FIG. 9B is the drawing that is illustrating the projected position of the reflected light image D2 upon observing from the direction of FIG. 9A. FIG. 9C is the drawing that is illustrating how the gemstone is observed from an opposite side to the FIG. 9A; and FIG. 9D is the drawing that is illustrating the projected position of the reflected light image D2 upon observing from the direction of FIG. 9C. Here, D2' depicted with a dotted line in FIG. 9B and FIG. 9D shows the projected position of the reflected light image D2 upon observing from the axis line direction.

The reflected light image D2 is observed larger when this is closer to the observation view point position of the observer E; and the reflected light image is observed smaller when this is farther from the observation view point position as shown in FIGS. 9A-9D. The reflected light image is observed in the state that this image swings so as to be pulled toward the view point direction of the observer E as a whole.

This observation is caused because the light path of the light that enters and emits from the facet is formed so long and the diamond is the material having a very high refractive index, among other reasons.

According to the present invention, the direction of the horizontal component of the inclination direction of the bezel facet 130 from the table 110 to the girdle 300 is set to be different from the direction of the horizontal component of the inclination direction of the main facet 220 from the culet 210 to the girdle 300 by 22.5°. Hence, the reflected image D4 formed so as to enclose the star facet 120 can be projected under the bezel facet 130, so that this exhibits the aesthetic effect that is completely different from that of the arrow shape that is projected to the conventional round brilliant cut.

In addition, according to the present invention, there is the opposite pair R that the star facet 120 and the main facet 220 are disposed in a position opposite to each other in the axis line direction, and the opposite pair R is disposed in a line symmetry position around the axis line as a symmetry axis; and thus, the reflected light image D2 derived from the light that enters from the star facet 120 can be projected with a large area. Accordingly, the aspect how the reflected light image D2 swings depending on the observation angle can be clearly observed.

On the other hand, in the conventional round brilliant cut, the reflected light image D2 was projected with a very small area. Accordingly, the aspect how the reflected light image swings depending on the observation angle could not be readily recognized, so that this could not delight the observer. To point out furthermore, the swinging phenomenon of the reflected light image has not been recognized, so that the cut shape with which the swinging aspect of the reflected light image can be recognized as in the present invention has not been investigated.

According to the present invention, the vertex 121 that is the nearest to the girdle 300 in the star facet 120 and the vertex 222 that is the nearest to the girdle 300 in the main facet 220 are disposed in the same plane (plane B) formed along the axis line (Z-axis); and thus, the aspect how the reflected light image D2 swings can be observed more clearly.

Namely, the migration point can be clearly recognized since the configuration is made such that the vertex 121 (the apex portion of the isosceles triangle) that is sharp toward the girdle 300 in the star facet 120 is projected under the table 110. Here, note that so far as the vertex 121 is disposed in the position where the light entering from the vertex 121 reflects twice in the main facet 220 and emits from the table 110, the same effect can be expressed. Therefore, it is not absolutely necessary for the vertex 121 to be in the same plane as the vertex 222, so that this can be arbitrarily disposed so as to change the design of the reflected light image.

On the other hand, in the conventional round brilliant cut, the vertex 111 (bottom angle portion of the isosceles triangle), which is shared with the table 110, in the star facet 120 is projected under the table 110, so that it was difficult for the observer to recognize the migration point. Namely, the migration range of the vertex 111 that is close to the center of the table 110 was so narrow that the migration range could not be clearly recognized.

In addition, according to the present invention, a first octagram that swings widely under the table 110 and a second octagram that encloses the star facet 120 and swings slightly (or does not swing) under the bezel facet 130 can be projected respectively. At this moment the first octagram that is projected inside the second octagram swings more widely relative to the second octagram, so that the aspect how the first octagram swings can be clearly recognized.

Here, in the present invention, it is not absolutely necessary for the number of the opposite pair R to be eight; it would be fine when at least two or more opposite pairs R are disposed in the line symmetry position with the axis line as the symmetry axis. For example, any of the design that four opposite pairs R are disposed in a four-fold symmetry position and the design that ten opposite pairs R are disposed in a ten-fold symmetry position may be fine. By changing the number of the opposite pair R in the way as described above, the swinging reflected light image patterns with various designs can be formed.

Next, with regard to the gemstone based on the same principle as the first embodiment, the cut having six opposite pairs R (second embodiment) and the cut having four opposite pairs R (third embodiment) will be explained. In the second embodiment and the third embodiment, the reflected image patterns that are different from those of the first embodiment are observed; but the expression principles of the basic reflected image patterns are all the same.

<Cut of the Gemstone According to the Second Embodiment of the Present Invention>

Hereinafter, the gemstone according to the second embodiment of the present invention will be explained in detail with referring to FIGS. 10A-10B and FIGS. 11A-11B. The gemstone according to the second embodiment is characterized by that the gemstone is provided with the crown 400 and the pavilion 500 the shapes of which are different from those of the gemstone according to the first embodiment. In this embodiment, explanation about the composition elements basically the same as those of the previous embodiment will be simplified by tagging the same symbols.

Figure 10A:
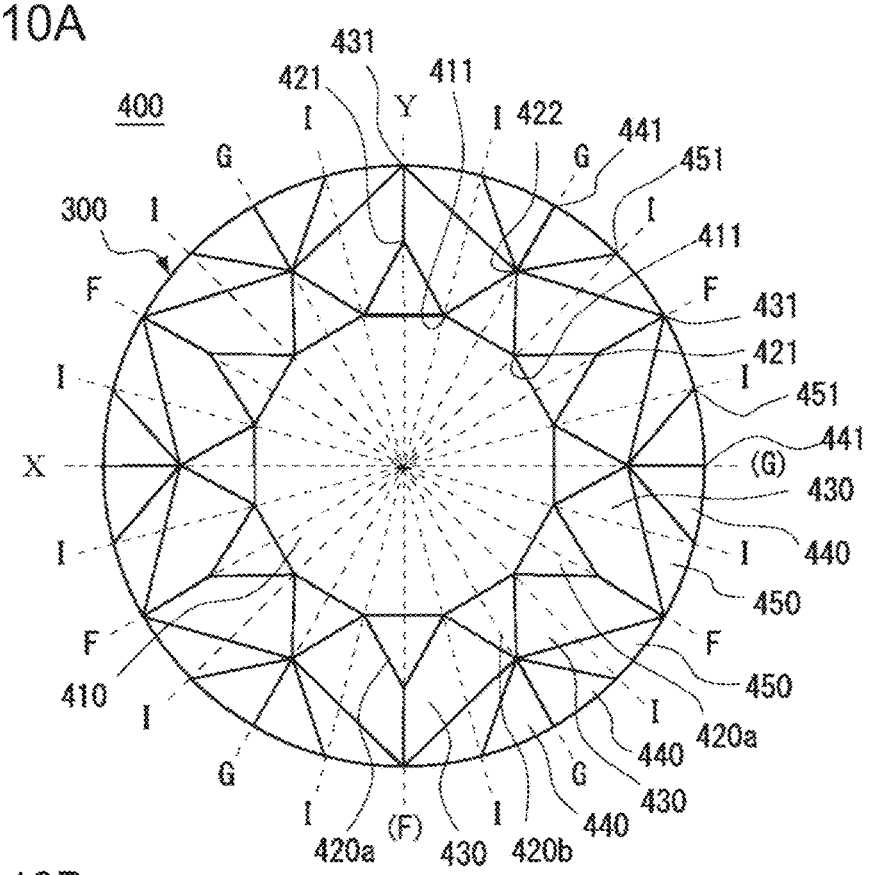
FIGS. 10A-10B illustrate an outer appearance of the gemstone according to the second embodiment of the present invention.
Figure 10B:
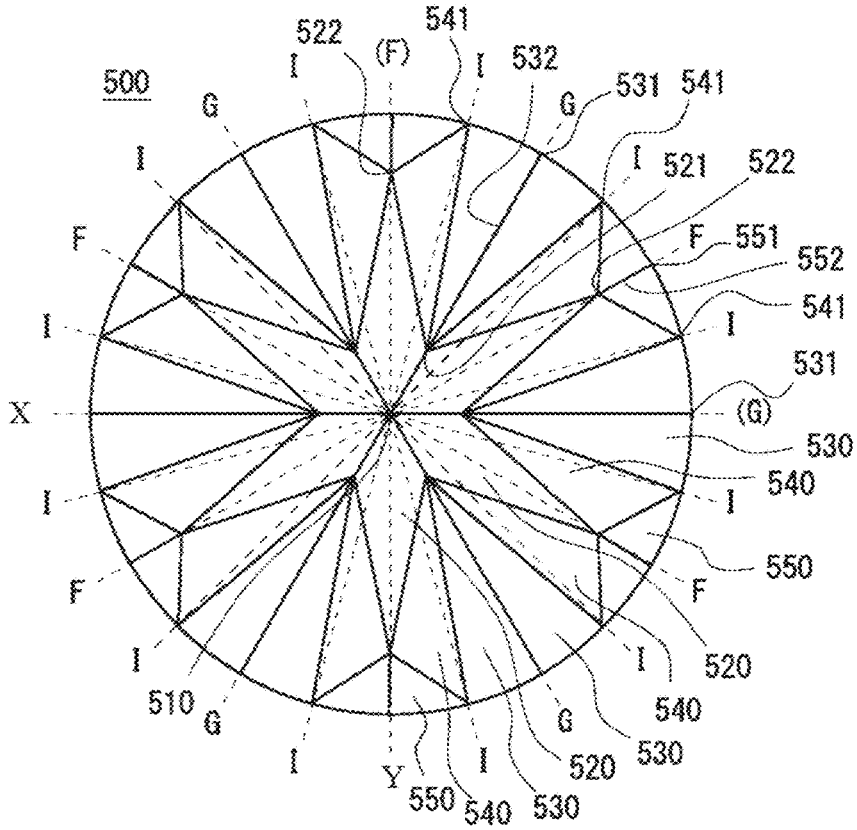

In FIG. 10A and FIG. 10B, the plane G that the ZX plane each is rotated around the Z-axis by 60°, the plane F that the plane G each is rotated around the Z-axis by 30°, and the plane I that the plane G and the plane F each are rotated around the Z-axis by 15° are depicted. In the explanation hereinafter, the direction extending from the axis line (Z-axis) to the girdle 300 along the plane F is defined as the F direction, the direction extending along the plane G is defined as the G direction, and the direction extending along the plane I is defined as the I direction. In FIG. 10A and FIG. 10B, this is not shown in the drawings since the Z-axis is directed to the front and back directions of the paper. Here, the ZX plane is regarded to be included in the plane Cc and the ZY plane is regarded to be included in the plane F.

In the crown side of the second embodiment, there are disposed the table 410 disposed in a center of the crown 400, twelve star facets 420 disposed so as to enclose the table 410, twelve bezel facets 430 disposed so as to enclose the star facet 420, twelve sub upper girdle facets 450 disposed so as to enclose the bezel facet 430, and twelve upper girdle facets 440 disposed adjacent to the sub upper girdle facets 450 and the girdle 300 as illustrated in FIG. 10A.

The table 410 is formed so as to be a dodecagonal shape having twelve vertices 411. The table 410 is a plane that is parallel to the XY plane. The vertices 411 each are disposed on the plane I so as to form the table 410 with a regular dodecagonal shape having the central angle of 30° as shown in FIG. 10A.

The star facet 420 is formed so as to be a trigonal shape formed by connecting two vertices 411 and 411, which are shared with the table 410, and the vertex 421 or the vertex 422, which are being disposed in the side closer to the girdle 300 than the vertices 411. The vertex 421 is disposed on the plane F, and the vertex 422 is disposed on the plane G Therefore, in the star facet 420, the star facet 420*a* disposed on the plane F and the star facet 420*b* disposed on the plane G are arranged alternately. It is preferable that the angle of the corner that is the nearest to the girdle 300 in the star facet 420 be set in the range of 50.0 to 70.0°.

The bezel facet 430 is formed so as to be a rectangular shape formed by connecting one vertex 411, which is shared with the table 410, two vertices 421 and 422, which are shared with the adjacent star facets 420, and the vertex 431 disposed in the upper part of the girdle 300. The vertex 431 is disposed at the position where the girdle 300 and the plane F intersect to each other. The bezel facet 430 is formed so as to be a rectangular shape having different interior angles in every corner, and is disposed so as to be in a line symmetry with the plane F as the symmetry axis.

Here, the direction of the horizontal component (I direction) of the inclination direction of the bezel facet 430 from the table 410 to the girdle 300 is set to be different from the direction of the horizontal component (F direction) of the inclination direction of the main facet 520 from the culet 510 to the girdle 300.

The sub upper girdle facet 450 is formed so as to be a fan-shaped by connecting the vertex 422, which is shared with the star facet 420*b*, the vertex 431, which is shared with the bezel facet 430, and the vertex 451 disposed at the position where the girdle 300 and the plane I intersect to each other.

The upper girdle facet 440 is formed so as to be a fan-shaped by connecting the vertex 422, which is shared with the star facet 420*b*, the vertex 441 disposed at the position where the girdle 300 and the plane G intersect to each other, and the vertex 451 disposed at the position where the girdle 300 and the plane I intersect to each other.

On the other hand, in the side of the pavilion, as can be seen in FIG. 10B, there are disposed the culet 510 disposed in the central position of the pavilion 500, six main facets 520 disposed radially around the culet 510, twelve sub facets 540 disposed so as to enclose the main facet 520, twelve lower girdle facets 530 disposed in adjacent to the long side of the sub facet 540, and twelve out facets 550 disposed in adjacent to the short side of the sub facet 540.

The main facet 520 is formed so as to be a rectangular shape formed by connecting the culet 510, two vertices 521 and 521, which are disposed in the adjacent planes G, and the vertex 522 disposed on the plane F. The vertex 521 is formed in the side of the culet 510 on the ridge line 532 formed on the plane G The vertex 522 is the starting point of the ridge line 552 formed on the plane F and is disposed to the side of the girdle 300. In other words, in the main facet 520, the distance from the culet 510 to the vertex 522 of the corner that is the nearest to the girdle 300 in the main facet 520 is set to be less than 90% relative to the distance from the culet 510 to the girdle 300.

The sub facet 540 is formed so as to be a trigonal shape by connecting the vertex 521, the vertex 522, both being shared with the main facet 520, and the vertex 541 disposed on the plane I. The long side of the sub facet 540 is the side connecting between the vertex 521 disposed in the side of the culet 510 and the vertex 541 on the girdle 300; and the short side thereof is the side connecting between the vertex 522 disposed in the side of the girdle 300 and the vertex 541.

The lower girdle facet 530 is formed so as to be a fan-shaped by connecting the vertex 521, which is shared with the main facet 520, the vertex 541, which is sheared with the sub facet 540, and the vertex 531 disposed at the position where the girdle 300 and the plane G intersect to each other. The lower girdle facets 530 are formed on both sides of the ridge line 532 with one for each side.

The out facet 550 is formed so as to be a fan-shaped by connecting the vertex 522, which is shared with the main facet 520, the vertex 541, which is shared with the sub facet 540, and the vertex 551 disposed at the position where the girdle 300 and the plane F intersect to each other. The out facets 550 are formed two on both sides of the ridge line 552 with one for each side.

Figure 11A:
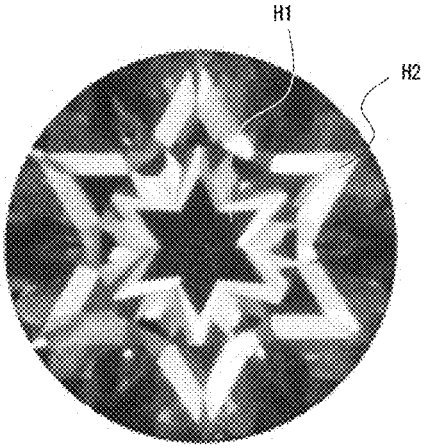
FIGS. 11A-11B are views illustrating a reflected light image observed in the gemstone according to the second embodiment of the present invention.
Figure 11B:
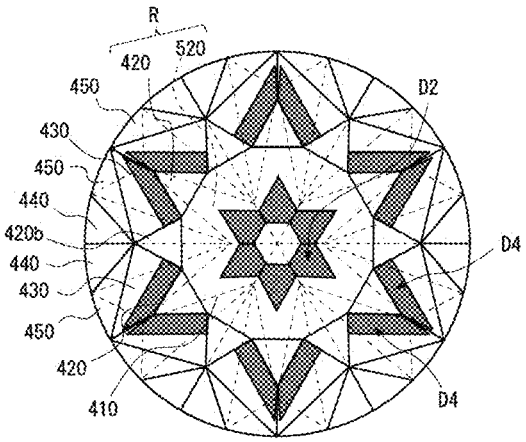

In this embodiment, the star facet 420*a* is disposed in the position opposite to the main facet 520 with each other in the axis line direction (see FIG. 11B). In other words, the star facet 420*a* and the main facet 520 form the opposite pair R in the position opposite with each other in the axis line direction. Six opposite pairs R are disposed so as to be in a six-fold symmetry around the axis line (Z-axis) as the center.

Here, the inclination angle α (see FIG. 3) of the star facet 420 and the inclination angle β (see FIG. 3) of the main facet 520 need to be set, similarly to the gemstone according to the first embodiment, so that a light that enters the star facet 420 is reflected by the two main facets 520 and 520 and emitted from the table 410.

Therefore, the inclination angle α of the star facet 420 to the table 410 is set in the range of 15.0 to 35.0°, and the inclination angle β of the main facet 520 to the table 410 is set preferably in the range of 37.0 to 43.0°.

When the inclination angle α of the star facet 420 is set to a lower limit side than 25.0°, which is the intermediate value of 15.0 to 35.0°, the inclination angle β of the main facet 520 is set preferably to a higher limit side than 40.0°, which is the intermediate value of 37.0 to 43.0°. On the contrary, when the inclination angle α of the star facet 420 is set to a higher limit side than the intermediate value (25.0°), the inclination angle β of the main facet 520 is set preferably to a lower limit side than the intermediate value (40.0°).

The inclination angle α of the star facet 420 to the table 410 is more favorably in the range of 23.0 to 28.0°, and the inclination angle β of the main facet 520 is more preferably in the range of 40.4 to 41.8°.

In addition, the inclination angle of the bezel facet 430 to the table 410 is set preferably in the range of 30.0 to 40.0°, and more preferably in the range of 31.0 to 36.0°.

The inclination angle α of the star facet 420 to the table 410 is more favorably in the range of 23.0 to 28.0°, and the inclination angle β of the main facet 520 is more preferably in the range of 40.4 to 41.8°.

In addition, the inclination angle of the bezel facet 430 to the table 410 is set preferably in the range of 30.0 to 40.0°, and more preferably in the range of 31.0 to 36.0°.

FIGS. 11A-11B are drawings that are depicting the reflected image pattern that is expressed in the crown side of the cut of the gemstone according to the second embodiment. FIG. 11A is a picture of the reflected image pattern taken by using the gemstone scope S. FIG. 11B is a schematic drawing that reflects the cut in the crown side (solid line) and the pavilion side (dotted line).

FIG. 11A shows a first hexagram pattern H1 formed in black by the reflected light image D2 is projected under the table 410; and a second hexagram pattern H2 formed in white by the reflected light image D4 is projected under the bezel facet 430.

The reflected light image D2 and the reflected light image D4 are projected by the same principle as the first embodiment, so that the reflected image pattern reflecting every facet shape of this embodiment is formed.

According to this embodiment, double hexagram pattern can be projected since six opposite pairs R are disposed so as to be in a six-folded symmetry around the axis line (Z-axis) as the center. Namely, the first hexagram H1 can be projected under the table 410, and the second hexagram H2 can be projected under the bezel facet 430. The position of the hexagram pattern is observed as if it swings depending on the observation angle since the first hexagram H1 is formed by the reflected light image D2.

According to this embodiment, in the main facet 520, the distance from the culet 510 to the vertex 521 of the corner that is the nearest to the girdle 300 in the main facet 520 is set to be less than 90% relative to the distance from the culet 510 to the girdle 300, hence the second hexagram H2 formed by the reflected light image D4 can be projected as the hexagram shape having almost the same side.

According to this embodiment, the number of the facets is increased by disposing the sub upper girdle facet 450 in the side of the crown 400, and the sub facet 540 and the out facet 550 in the side of the pavilion 500, so that the beautiful shine inherent to the diamond such as brilliance, fire, and sparkle can be enhanced.

<Cut of the Gemstone According to the Third Embodiment of the Present Invention>

Hereinafter, the gemstone according to the third embodiment of the present invention will be explained in detail with referring to FIGS. 12A-12B and FIG. 13. The gemstone according to the third embodiment is characterized by that the gemstone is provided with the crown 600 and the pavilion 700 the shapes of which are different from those of the gemstone according to the first and the second embodiments. In this embodiment, explanation about the composition elements basically the same as those of the previous embodiments will be simplified by tagging the same symbols.

Figure 12A:
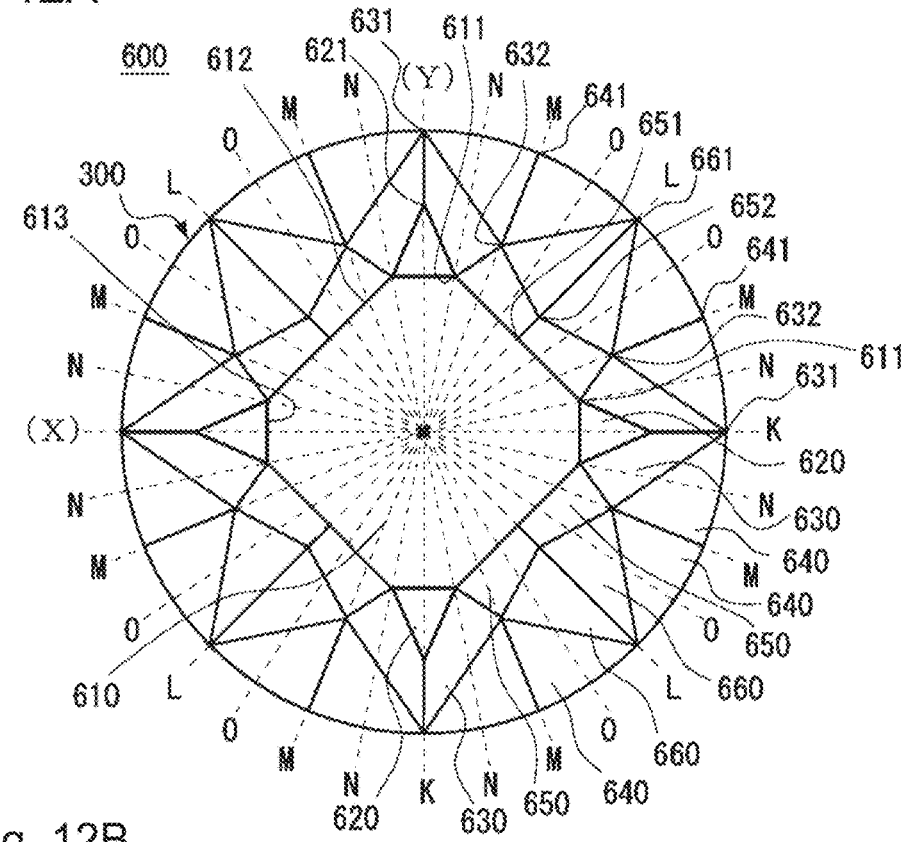
FIGS. 12A-12B illustrate an outer appearance of the gemstone according to the third embodiment of the present invention.
Figure 12B:
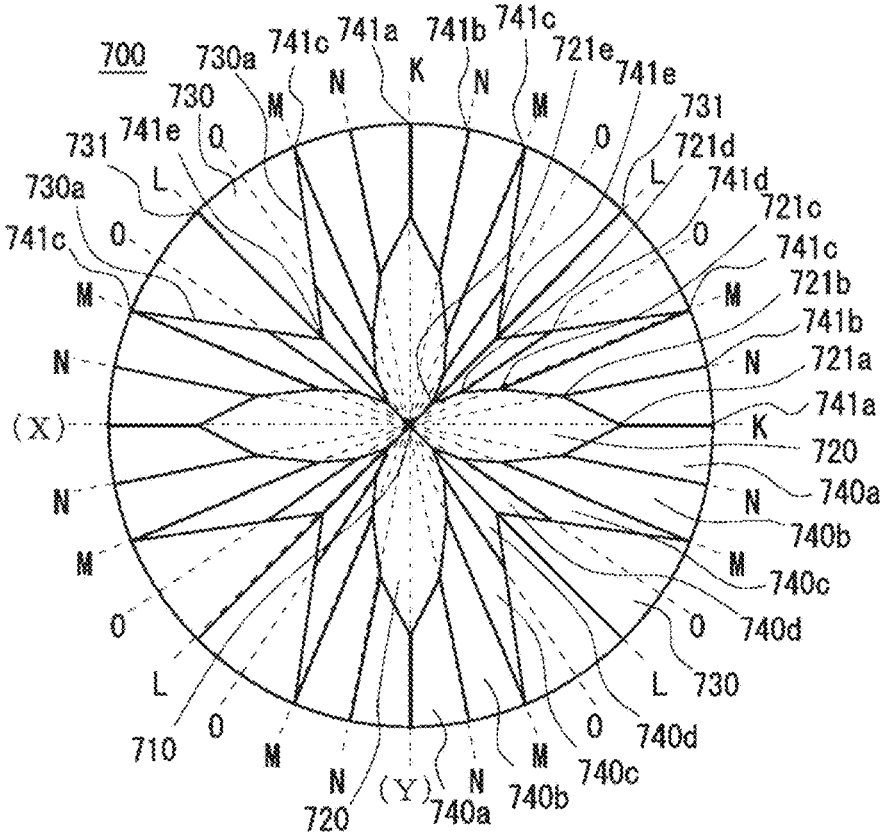

FIG. 12A and FIG. 12B depict: the plane L that the plane K (ZX plane and ZY plane) each is rotated around the Z-axis by 45°; the plane M that the plane K or the plane L each is rotated around the Z-axis by 22.5°; the plane N that the plane K is rotated to both directions by 11.25° with the Z-axis as the center; and the plane O that the plane L is rotated to both directions by 11.25° with the Z-axis as the center. In the explanation hereinafter, the direction extending from the axis line (Z-axis) to the girdle 300 along the plane K is defined as the K direction, the direction extending along the plane L is defined as the L direction, the direction extending along the plane M is defined as the M direction, the direction extending along the plane N is defined as the N direction, and the direction extending along the plane O is defined as the O direction.

In FIG. 12A and FIG. 12B, this is not shown in the drawings since the Z-axis is directed to the front and back directions of the paper.

In the crown side of the third embodiment, there are disposed the table 610 disposed in a center of the crown 600, four star facets 620 disposed to four directions outside the table 610, eight bezel facets 630 disposed so as to enclose the star facet 620, eight second bezel facets 650 disposed outside the table 610, eight third bezel facets 660 disposed outside the second bezel facet 650, and sixteen upper girdle facets 640 disposed outside the bezel facet 630 and the third bezel facet 660 as illustrated in FIG. 12A.

The table 610 is formed so as to be an octagonal shape having eight vertices 611. The table 610 is a plane that is parallel to the XY plane. The vertices 611 each are disposed on the plane N so as to form the table 610 with an octagonal shape having four long sides 612 and four short sides 613 as shown in FIG. 12A.

The star facet 620 is formed so as to be a trigonal shape formed by connecting two vertices 611 and 611, which are shared with the table 610, and the vertex 621 disposed in the side closer to the girdle 300 than the vertices 611. The vertex 621 is disposed on the plane K and forms the star facet 620 that is an isosceles triangle having an interior angle contacting with the vertex 621 as the apex angle.

The bezel facet 630 is formed so as to be a rectangular shape formed by connecting the vertex 611, the vertex 621, both being shared with the star facet 620, the vertex 631 disposed at the position where the plane K and the girdle 300 intersect to each other, and the vertex 632 disposed on the plane M. The bezel facets 630 are disposed in a line symmetry position with the plane K as the symmetry axis.

The second bezel facet 650 is formed so as to be a rectangular shape formed by connecting the vertex 611, the vertex 632, both being shared with the bezel facet 630, the vertex 651 disposed at the position where the long side 612 and the plane L intersect to each other, and the vertex 652 disposed in the side closer to the girdle 300 than the vertex 651.

The third bezel facet 660 is formed so as to be a trigonal shape formed by connecting the vertex 632, the vertex 652, both being shared with the second bezel facet 650, and the vertex 661 disposed at the position where the plane L and the side of the girdle 300 intersect to each other.

Here, the direction of the horizontal component (N direction, M direction, or 0 direction) of the inclination direction of the bezel facet 630, 650, or 660 from the table 610 to the girdle 300 is set to be different from the direction of the horizontal component (K direction) of the inclination direction of the main facet 720 from the culet 710 to the girdle 300.

The upper girdle facet 640 is formed so as to be a fan-shaped by connecting the vertex 632, which is shared with the third bezel facet 660, the vertex 641 disposed at the position where the plane M and the side of the girdle 300 intersect to each other, and the vertex 631, which is shared with the bezel facet 630, or the vertex 661, which is shared with the third bezel facet 660.

On the other hand, in the side of the pavilion, as can be seen in FIG. 12B, there are disposed the culet 710 disposed in the central position of the pavilion 700, four main facets 720 disposed radially around the culet 710, thirty two sub facets 740 disposed so as to enclose the main facet 720, and eight lower girdle facets 730.

The main facet 720 is formed so as to be a decagonal shape formed by connecting the vertex 721*a* disposed in the position close to the girdle 300 on the plane K, two vertices 721*b* disposed in the position close to the girdle 300 on the plane N, two vertices 721*c* disposed in the position close to the culet 710 on the plane M, two vertices 721*d* disposed in the position close to the culet 710 on the plane O, two vertices 721*e* disposed in the position close to the culet 710 on the plane L, and the culet 710.

The main facets 720 are disposed radially to four directions from the culet 710 as the center.

The lower girdle facet 730 is formed so as to be a fan-shaped by connecting the vertex 731 disposed at the position where the girdle 300 and the plane L intersect to each other, the vertex 741*e* disposed near the intermediate position between the culet 710 and the girdle 300 on the plane L, and the vertex 741*c* disposed at the position where the girdle 300 and the plane M intersect to each other. The ridge line 730*a* connecting between the vertex 741*e* and the vertex 741*c* of the lower girdle facet 730 contacts with the sub facet 740*c* and the sub facet 740*d* to be described later.

In the sub facet 740, four sub facets are disposed so as to enclose the main facet 720; they are the sub facet 740*a*, the sub facet 740*b*, the sub facet 740*c*, and the sub facet 740*d*, in the order of the farthest from the culet 710.

The sub facet 740*a* is formed so as to be a rectangular shape having one arc side, formed by connecting the vertex 721*a*, the vertex 721*b*, both being shared with the main facet 720, the vertex 741*a* disposed at the position where the girdle 300 and the plane K intersect to each other, and the vertex 741*b* disposed at the position where the girdle 300 and the plane N intersect to each other.

The sub facet 740*b* is formed so as to be a rectangular shape having one arc side, formed by connecting the vertex 721*b*, the vertex 721*c*, both being shared with the main facet 720, the vertex 741*b* disposed at the position where the girdle 300 and the plane N intersect to each other, and the vertex 741*c* disposed at the position where the girdle 300 and the plane M intersect to each other.

The sub facet 740*c* is formed so as to be a rectangular shape formed by connecting the vertex 721*c*, the vertex 721*d*, both being shared with the main facet 720, the vertex 741*c* disposed at the position where the girdle 300 and the plane M intersect to each other, and the vertex 741*d* disposed at the position where the plane O and the ridge line 730*a* intersect to each other.

The sub facet 740*d* is formed so as to be a rectangular shape formed by connecting the vertex 721*d*, the vertex 721*e*, both being shared with the main facet 720, the vertex 741*d*, which is shared with the sub facet 740*c*, and the vertex 741*e*, which is shared with the lower girdle facet 730.

In this embodiment, the star facet 620 is disposed in the position opposite to the main facet 720 with each other in the axis line direction. In other words, the star facet 620 and the main facet 720 form the opposite pair R in the position opposite with each other in the axis line direction; and four opposite pairs R are disposed so as to be in a four-fold symmetry around the axis line (Z-axis) as the center.

Here, the inclination angles of the star facet 620, the bezel facet 630, and the main facet 720 are set, similarly to the gemstone according to the first and second embodiments, so that a light that enters the star facet 620 is reflected by the two main facets 720 and 720 and emitted from the table 610. The inclination angles of the star facet 620, the bezel facet 630, and the main facet 720 are set in the same ranges as those of the gemstone according to the first and second embodiments.

Figure 13:
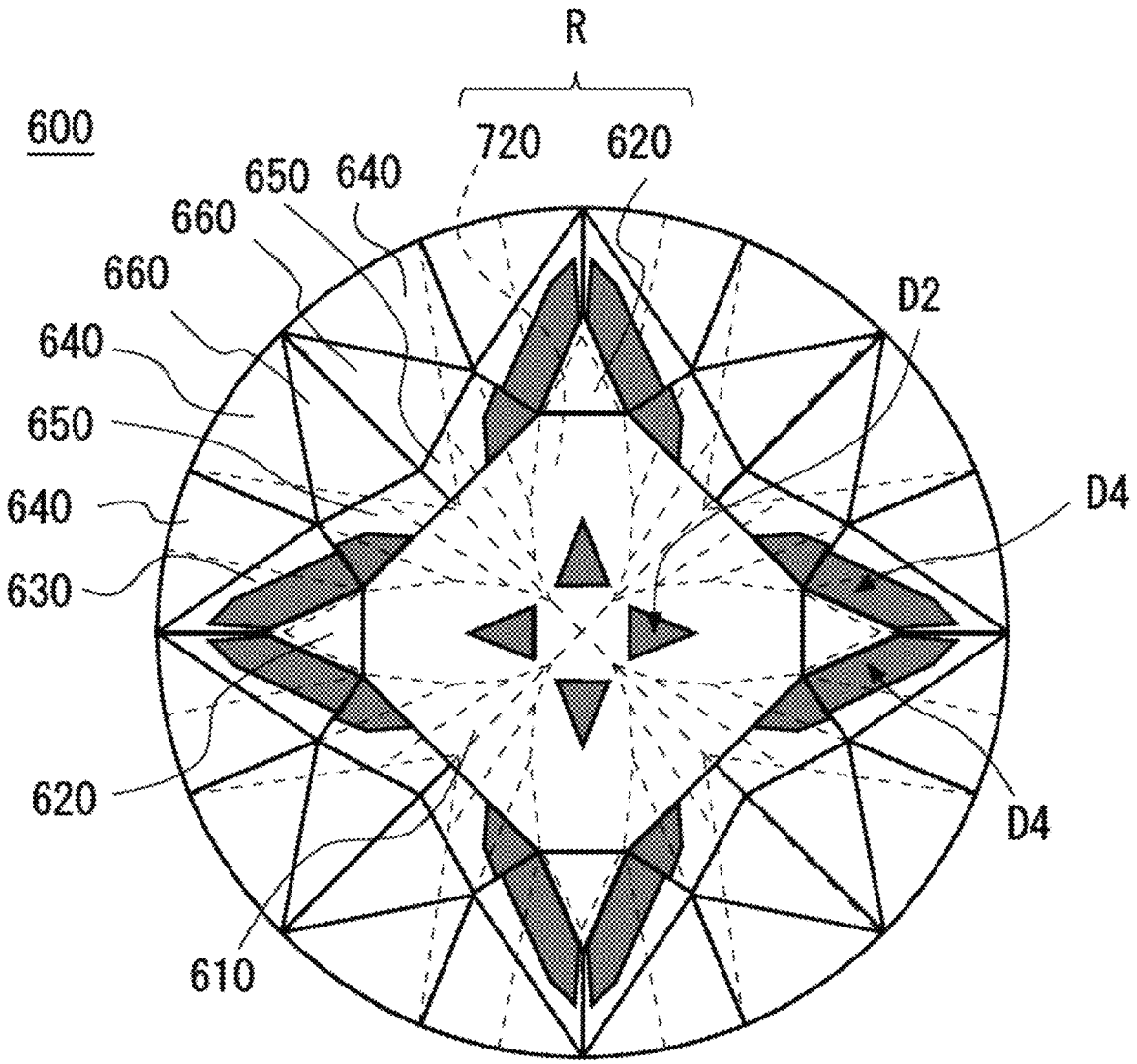
FIG. 13 is a view illustrating a reflected light image observed in the gemstone according to the third embodiment of the present invention.

FIG. 13 is the drawing that is depicting the reflected image pattern expressed in the crown side of the cut of the gemstone according to the third embodiment. A first crisscross pattern formed by the reflected light image D2 is projected under the table 610; and a second crisscross pattern formed by the reflected light image D4 is projected under the bezel facet 630 as shown in FIG. 13.

The reflected light image D2 and the reflected light image D4 are projected by the same principle as the first and second embodiments, so that the reflected image pattern reflecting every facet shape of this embodiment is formed. Therefore, originally, the first crisscross pattern is projected darkly and the second crisscross pattern is projected lightly.

According to this embodiment, four opposite pairs R are disposed so as to be in a four-fold symmetry around the axis line (Z-axis) as the center, so that the crisscross patterns can be projected to the table 610 and the bezel facet 630. In addition, the first crisscross pattern is formed by the reflected light image D2, so that the crisscross pattern is observed as if it swings depending on the observation angle.

As described in the first to the third embodiments, by changing the number, shape, and disposition of the opposite pair R, the reflected light image patterns with various designs can be formed. Namely, the designs of the projected pattern of the octagram in the first embodiment, the hexagram in the second embodiment, and the crisscross in the third embodiment were shown; but by appropriately changing the number, shape, and disposition of the opposite pair R, various polygons other than the above-mentioned can be projected.

For example, two opposite pairs R in one line symmetry position may be disposed on the plane K and two opposite pairs R in other line symmetry position may be disposed on the plane L so that the crisscross patterns projected under the table 610 of the third embodiment may be crossed with the angle of 60°. The angle of the opposite pairs R to the axis line can be changed arbitrarily as described above, so that the reflected image patterns with various designs can be formed.

Figure 14:
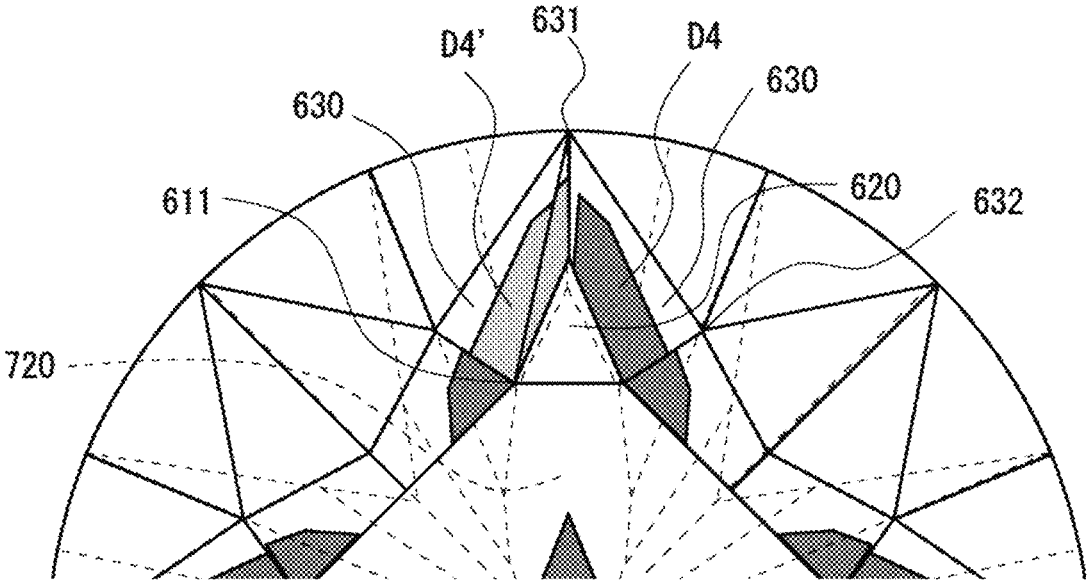
FIG. 14 is a reflected light image observed when the bezel facet is divided in the gemstone according to the third embodiment of the present invention.

In addition, as illustrated in FIG. 14, by dividing the bezel facet into two facets having different inclination directions, the design of the reflected light image D4 that appears under the bezel facet can be changed (see the reflected light image D4'). In FIG. 14, the dividing example into two is shown; but it is natural that dividing into three or more can be made as well.

DESCRIPTION OF SYMBOLS

100, 400, 600 Crown
110, 410, 610 Table
120, 420, 620 Star facet
130, 430, 630 Bezel facet
140, 440, 640 Upper girdle facet
450 Sub upper girdle facet
650 Second bezel facet
660 Third bezel facet
200, 500, 700 Pavilion
210, 510, 710 Culet
220, 520, 720 Main facet
230, 530, 730 Lower girdle facet
540, 740 Sub facet
550 Out facet
300 Girdle
D1 to D5 Reflected light image
S Gemstone scope
E Observer

The invention claimed is:

1. A gemstone comprising:

a crown, a pavilion, and a girdle formed between the crown and the pavilion;

the crown consisting of a table, an even number of star facets bordering on the table, an even number of bezel facets that border on the star facets, an even number of sub upper girdle facets, and an even number of upper girdle facets;

each one of the bezel facets has four edges; and for each one of the bezel facets two of the four edges thereof border on a respective two of the star facets;

each one of the sub upper girdle facets has three edges; and for each one of the sub upper girdle facets one edge thereof borders on a respective one of the bezel facets and one edge thereof borders on the girdle;

each one of the upper girdle facets has three edges; and for each one of the upper girdle facets one edge thereof borders on a respective one of the sub upper girdle facets, one edge thereof borders on the girdle and one edge thereof borders on another one of the upper girdle facets;

the pavilion includes a culet, an even number of main facets, and an even number of ridge lines, the main facets are disposed symmetrically about a Z-axis in a back view of the gemstone;

each one of the main facets has four edges, an inner vertex, and an outer vertex; the inner vertexes of the main facets meet one another at the culet; the outer vertexes terminate short of the girdle; and each one of the ridge lines extends from the outer vertex of a respective one of main facets to the girdle;

the number of star facets is equal to or greater than the number of main facets;

the gemstone has two or more pairs of the star facets and the main facets, each pair having one star facet and one main facet; the star facet and the main facet of each pair are disposed at positions opposite to each other;

each one of the star facets is arranged at an inclination angle $\alpha$ of 23.0 to 28.0 degrees;

each one of the main facets is arranged at an inclination angle $\beta$ of 40.4 to 41.8 degrees; and wherein the inclination angle $\alpha$ of the star facets and the inclination angle $\beta$ of the main facets are set so that light from a front direction of the table that enters each one of the star facets is reflected twice by two of the main facets and then is emitted through the table whereby a reflected image pattern of a shape of at least some of the star facets is formed in the table.

2. The gemstone according to claim 1, wherein for each pair of the star facets and the main facets, an outer vertex of the star facet of the pair and a vertex of the main facet of the pair are disposed on a common axis.

3. The gemstone according to claim 1, comprising six or more of the star facets, and six of the main facets.

4. The gemstone according to claim 1, wherein the pavilion further comprises an even number of sub facets, an even number of lower girdle facets, and an even number of out facets;

each one of the sub facets has three edges; and for each one of the sub facets one edge thereof borders on a respective one of the main facets, and each one of the sub facets has a vertex at the girdle;

each one of the lower girdle facets has three edges; and for each one of the lower girdle facets one edge thereof borders on a respective one of the sub facets, one edge thereof borders on the girdle, and one edge thereof border on another one of the lower girdle facets;

each one of the out facets has three edges; and for each one of the out facets one edge thereof borders on a respective one of the sub facets, one edge thereof borders on the girdle, and one edge thereof borders on another one of the out facets.

5. The gemstone according to claim 1, wherein the gemstone is a diamond.

6. The gemstone according to claim 1, wherein each bezel facet has an inclination angle of 30.0 to 40.0 degrees.

* * * * *